US009242906B2

(12) United States Patent
Coulouarn et al.

(10) Patent No.: US 9,242,906 B2
(45) Date of Patent: Jan. 26, 2016

(54) MELT-CAST INSENSITIVE EXPLOSIVE COMPOSITION

(75) Inventors: Christophe Coulouarn, Arcay (FR); Stéphane Bulot, Bourges (FR)

(73) Assignee: NEXTER MUNITIONS, Versailles (FR)

( * ) Notice: Subject to any disclaimer, the term of this patent is extended or adjusted under 35 U.S.C. 154(b) by 0 days.

(21) Appl. No.: 13/515,647

(22) PCT Filed: Dec. 20, 2010

(86) PCT No.: PCT/FR2010/000853

§ 371 (c)(1), (2), (4) Date: Jul. 27, 2012

(87) PCT Pub. No.: WO2011/086246

PCT Pub. Date: Jul. 21, 2011

(65) Prior Publication Data

US 2012/0305149 A1 Dec. 6, 2012

(30) Foreign Application Priority Data

Dec. 23, 2009 (FR) ..... 09 06239

(51) Int. Cl.
*C06B 21/00* (2006.01)
*C06B 45/02* (2006.01)

(52) U.S. Cl.
CPC ..... *C06B 21/005* (2013.01); *C06B 21/00* (2013.01); *C06B 45/02* (2013.01)

(58) Field of Classification Search
CPC ..... C06B 25/34; C06B 45/06; C06B 31/54; C06B 45/00; C06B 21/00
See application file for complete search history.

(56) References Cited

U.S. PATENT DOCUMENTS

| | | | | |
|---|---|---|---|---|
| 3,994,756 | A | 11/1976 | Hendrickson, Sr. et al. | |
| 5,034,072 | A * | 7/1991 | Becuwe | 149/19.4 |
| 5,996,501 | A * | 12/1999 | Spencer et al. | 102/286 |
| 2005/0081970 | A1 | 4/2005 | Hofmann et al. | |

(Continued)

FOREIGN PATENT DOCUMENTS

| | | | |
|---|---|---|---|
| DE | 23 35 926 | A1 | 1/1975 |
| DE | 36 05 634 | A1 | 8/1987 |
| DE | 38 04 397 | C1 | 9/1989 |

(Continued)

OTHER PUBLICATIONS

Mar. 9, 2011 International Search Report issued in International Patent Application No. PCT/FR2010/000853 (with translation).

(Continued)

*Primary Examiner* — Aileen B Felton
(74) *Attorney, Agent, or Firm* — Oliff PLC

(57) ABSTRACT

An insensitive melt-cast explosive composition incorporating on the one hand a meltable part formed of at least one meltable explosive and, on the other hand, a solid part incorporating oxynitrotriazole (ONTA) and cyclonite (RDX). This composition is characterised in that the cyclonite is a cyclonite of reduced sensitivity, the particle size of the insensitive cyclonite being of between 315 micrometers and 800 micrometers, whereas the particle size of the ONTA is of between 200 micrometers and 400 micrometers, the ONTA further having an apparent density greater than or equal to 0.95 g/cm$^3$. The invention is applied to the loading of projectiles by casting.

14 Claims, 1 Drawing Sheet

(56) References Cited

U.S. PATENT DOCUMENTS

Figure 1:
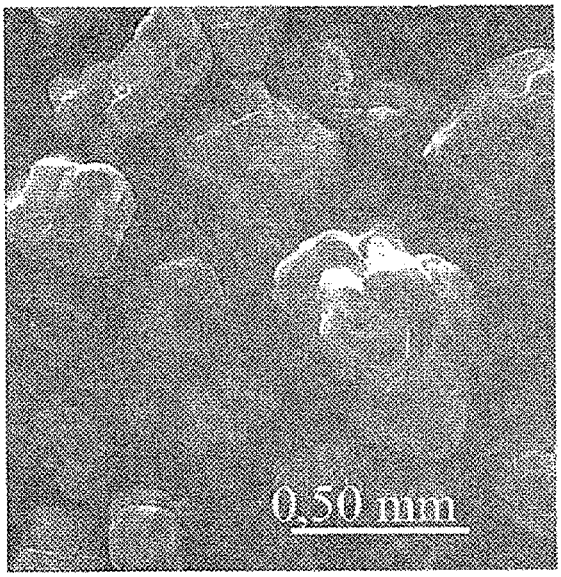

| | | | |
|---|---|---|---|
| 2006/0272755 | A1 | 12/2006 | Borne |
| 2010/0258233 | A1 | 10/2010 | Tonomura et al. |

FOREIGN PATENT DOCUMENTS

| | | | |
|---|---|---|---|
| DE | 197 19 073 | A1 | 11/1998 |
| EP | 0 519 798 | A1 | 12/1992 |
| EP | 0 814 069 | A1 | 12/1997 |
| FR | 2 436 119 | A1 | 4/1980 |
| FR | 2 738 562 | A1 | 3/1997 |
| FR | 2 886 641 | A1 | 12/2006 |
| FR | 2 887 544 | A1 | 12/2006 |
| FR | 2 917 169 | A1 | 12/2008 |
| FR | 2 923 005 | A1 | 5/2009 |

OTHER PUBLICATIONS

Hamshere et al., "Australian Reduced Sensitivity RDX and its use in Polymer Bonded Explosives," presentation given in Meppen (Germany) on Nov. 17-20, 2003.

Vaullerin et al., "Prediction of Explosives Impact Sensitivity," *Propellants, Explosives, Pyrotechnics*, 1998, vol. 23, pp. 237-239.

Becuwe et al., "EIDS High Explosives for 1.6 Munitions," *Chemical Abstracts*, 1998, vol. 128, No. 10, p. 780.

Kim et al., "Nucleation Kinetics in Spherulitic Crystallization of Explosive Compound: 3-Nitro1,2,4-Triazol-5-One," *Powder Technology*, 2001, vol. 19, No. 2-3, pp. 109-116.

* cited by examiner

MELT-CAST INSENSITIVE EXPLOSIVE COMPOSITION

The technical scope of the invention is that of insensitive melt-cast explosive compositions.

Designing low vulnerability ammunition, often termed "muratised" from the French MURAT (Munitions à Risques Atténués), is a major preoccupation for developers.

This ammunition must have very low or inexistent vulnerability to external aggressions. Vulnerability tests are defined, for example, by the modes of operation described in the standards AFNOR NFT 70510 to 70515, or by the following UN tests 7d)i (bullet impact), 7e) (fire resistance), 7f) (slow cook-off), 7g), 7h), 7j), and 7k).

This low vulnerability is essentially obtained by using an insensitive explosive composition.

Insensitive explosive compositions have already been proposed that can be implemented by casting. Patent EP814069 thus describes a certain number of compositions associating a meltable part and a solid part. The meltable part essentially comprises an aromatic nitro compound such as Trinitrotoluene (TNT) associated with a phlegmatizer, such as wax.

The solid part generally comprises oxynitrotriazole (ONTA), which is a granular explosive whose vulnerability is reduced. ONTA is more particularly described in patent EP-210881.

It is known to associate ONTA with aluminium powder, to increase the blast effect, and also with another granular solid explosive to increase the detonic performances of the composition.

It is thus classical to associate ONTA with cyclonite (RDX) or octogen (HMX).

However, increasing the mass of cyclonite or octogen has a detrimental effect on the insensitivity of the explosive composition thus obtained.

An insensitive cyclonite (RDX) is further known that is obtained by a specific crystallisation process. This insensitive cyclonite (known by the trade name of i-RDX registered by Eurenco, or by the name RS-RDX) is namely described by patents FR2887544 and FR2917169.

It is tempting to implement such a cyclonite in combination with ONTA to produce insensitive explosive compositions in which the proportion of cyclonite would be enhanced as well as the detonic performances.

However, such a substitution does not, a priori, produce the expected advantages.

Compositions have thus been produced in which 40% in mass of Trinitrotoluene is associated with 60% in mass of insensitive cyclonite (supplied by different sources). The impact pressure values were measured as well as the number of perforated cards (test according to the French standard AFNOR NFT 70-502 "Priming the detonation through a barrier").

In accordance with this sensitivity test, priming is performed through screen cards. The number of cards given is the minimum number required to prevent priming and therefore to prevent the ignition of the explosive being tested. In practical terms, a so-called insensitive explosive produces no ignition through around 140 cards. Classical explosives require more than 200 cards.

These results were thereafter compared with those obtained for a composition associating classical cyclonite (or non insensitive RDX) and TNT in the same proportions.

Table 1 below shows the results obtained.

TABLE 1

| Explosive compositions | Number of cards | Impact pressure (Giga Pascals) |
|---|---|---|
| TNT 40%/insensitive RDX 60% (supplier A) | 234 | 1.7 |
| TNT 40%/insensitive RDX 60% (supplier B) | 234 | 1.7 |
| TNT 40%/non insensitive RDX 60% | 235 | 1.7 |

As can be observed, the simple substitution of classical RDX by an insensitive RDX does not modify the sensitivity of a composition associating TNT and RDX.

In fact, the number of perforated cards remains substantially the same. The use of insensitive RDX therefore does not improve the insensitivity in TNT-based melt-cast compositions. These conclusions were presented during a Technical Meeting of the NIMIC on insensitive RDX ("Australian Reduced Sensitivity RDX and its use in polymer Bonded Explosives" presentation given in MEPPEN (Germany) on 17-20 Nov. 2003 (B. L. Hamshere, I. J. Locchert, F. Mark, Australian Government, DoD).

The aim of the invention is to propose an insensitive melt-cast explosive composition in which the proportion of cyclonite (RDX) is increased with respect to the proportion of oxynitrotriazole (ONTA) (thereby improving the detonic performances) but without there being any reduction in the insensitivity of the composition thus obtained.

Thus, the invention relates to an insensitive melt-cast explosive composition incorporating firstly a meltable part formed of at least one meltable explosive and secondly a solid part incorporating oxynitrotriazole (ONTA) and cyclonite (RDX), composition wherein the cyclonite is a cyclonite of reduced sensitivity, the particle size of the insensitive cyclonite being of between 315 micrometres and 800, whereas the particle size of the ONTA is of between 200 micrometers and 400 micrometers, the ONTA further having an apparent density greater than or equal to 0.95 g/cm$^3$.

According to different embodiments of the invention, the meltable explosive can be selected from among the following: Trinitrotoluene, 2,4,6-Trinitro-N-Methyl Aniline, 2,4,6-Trinitro-3-methylphenol, 3-Amino-Trinitrotoluene, 2,4,6-Trinitro-Aniline, 1,3,8-Trinitronaphtalene and its mixture of isomers meltable at 115° C., 2,4-dinitroanisole (DNAN).

The meltable part will advantageously constitute between 30% and 40% of the total mass of the composition.

The solid part may thus associate:

15% to 35% in mass of oxynitrotriazole

24% to 50% in mass of insensitive cyclonite and 0 to 25% in mass of aluminium, the percentages in mass here being relative to the total mass of the solid part.

More specifically, an explosive composition may be produced with the following composition:

15% to 30% in mass of oxynitrotriazole,

15% to 30% in mass of insensitive cyclonite, 0 to 15% in mass of aluminium,

20% to 33% in mass of trinitrotoluene,

7% to 10% in mass of a mixture of wax and casting additives, the percentages in mass here being relative to the total mass of the composition.

Figure 2:
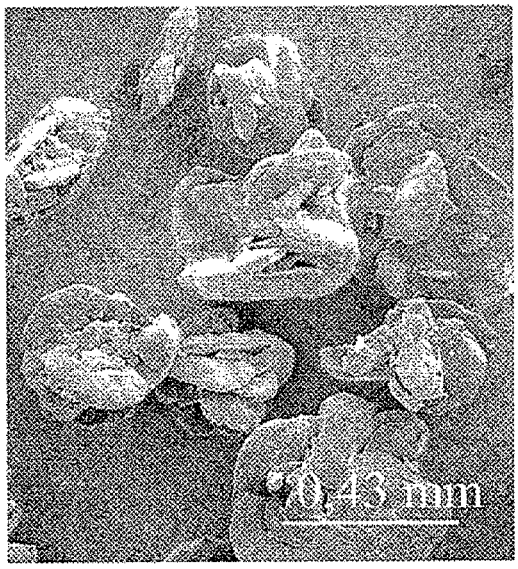

The invention will be described with reference to the appended drawings, in which:

FIG. 1 is a photograph of the grains of a type 1 ONTA (apparent density greater than 0.95 g/cm$^3$), and FIG. 2 is a photograph of the grains of a type 2 ONTA (apparent density less than 0.95 g/cm$^3$).

The work performed by the inventors firstly led them to choose a relatively large (315 to 800 micrometers) particle size for the insensitive cyclonite.

However, the different studies performed on the subject (by the Saint Louis Institute—ISL, for example) suggest that the use of insensitive cyclonite of a reduced particle size (more often than not it is the particle size cut of 0 to 100 micrometers which is advised) enables the best results to be obtained in terms of insensitivity. This recommendation is based on the fact that it is recognised that low particle sizes for the RDX are less sensitive because of the lesser number of crystalline defects that they contain.

The inventors have, however, chosen a larger particle size (thus, a priori less appropriate) since its association with the particle size cut of 200 to 400 micrometers for the ONTA gives a lower porosity for the granular mixture ONTA/RDX/Aluminium and also for the explosive composition that is made thereafter after casting the TNT.

Table 2 below enables the relative porosities of different associations of particle sizes to be compared:

| Type of ONTA | ONTA particle size (micrometers) | Insensitive RDX particle size (micromètres) | Aluminium particle size (micrometers) | Porosity of granular mixture (%) |
|---|---|---|---|---|
| Type 1 | 200 to 400 | 315 to 800 | 43 | 9.3 |
| Type 1 | 200 to 400 | 75 to 300 | 43 | 15.2 |
| Type 1 | 200 to 400 | 0 to 200 | 43 | 22.9 |
| Type 1 | 200 to 400 | 0 to 100 | 43 | 34.2 |
| Type 2 | 200 to 400 | 315 to 800 | 43 | 24.3 |
| Type 2 | 200 to 400 | 75 to 300 | 43 | 26.8 |
| Type 2 | 200 to 400 | 0 to 200 | 43 | 30.3 |
| Type 2 | 200 to 400 | 0 to 100 | 43 | 35.2 |

For each test, 48% in mass of ONTA was associated with 22% in mass of aluminium and 30% in mass of insensitive RDX.

Two types of ONTA, differentiated by the morphology of their grains, were tested. Type 1 ONTA is an ONTA comprising rounded, spheroidal grains with relatively few surface irregularities.

Type 2 ONTA has grains of a more irregular external shape.

FIG. 1 shows a photograph of type 1 ONTA grains. FIG. 2 shows a photograph of type 2 ONTA grains. These photographs were taken by Scanning Electron Microscopy.

In addition to the external aspect of the grains (rounded for type 1 and irregular for type 2), one ONTA can easily be distinguished from the other by the value of its apparent density $\rho_b$. This density (expressed in grams per cubic centimetre) is calculated by the ratio of the mass of non-compacted material in a given volume (volume thus including the interstitial spaces between the grains).

This apparent density differs from the true density which is that of the material itself and which hardly differs from one type of ONTA to the other. The true density of ONTA is of around 1.9 g/cm$^3$. The apparent density of $\rho_b$ the type 1 ONTA tested is greater than 0.95 g/cm$^3$ (depending on the samples tested, this apparent density was of between 0.95 g/cm$^3$ and 1 g/cm$^3$).

The apparent density $\rho_b$ of the type 2 ONTA tested is of between 0.75 g/cm$^3$ and 0.85 g/cm$^3$.

It is clear that a high apparent density leads to a reduction in the porosity of the powder mixture.

As can be observed in Table 2, it is the association of insensitive RDX of 315-800 micrometers with type 1 ONTA of 200-400 micrometers which leads to the lowest porosity (around 9%) for the granular mixture.

Table 2 also shows that, for a given particle size cut, the porosity is lower when the ONTA selected is type 1 ONTA, which is to say when the grains are rounded (apparent density of this ONTA being between 0.95 and 1 g/cm$^3$). Any other apparent density $\rho_b$ value greater than 1 of the ONTA would enable the porosity percentage to be reduced (the theoretical maximum being of the true density of 1.9 g/cm$^3$).

It is this reduction of the porosity for the granular phase that also enables the porosity of the composition obtained after casting the TNT to be reduced. The reduction in porosity of the cast composition will reduce its sensitivity to shocks (hot spot stresses during the compression of the intergranular zones).

The inventors thus tried to associate particle size cuts of the oxynitrotriazole (with the most rounded grains) and the insensitive cyclonite in such a way as to reduce this porosity. The optimisation of the particle size cuts implemented as well as the choice of a high apparent density ONTA enabled an optimal compactness of the granular phase to be obtained.

This resulted in a reduction in the sensitivity of the composition with retaining a reinforced cyclonite component. Furthermore, the use of insensitive cyclonite with a relatively high particle size facilitates its implementation (powder flows more freely). The porosity of the grain mixture will be chosen less than 10% to ensure that porosity is obtained for the composition of less than 0.5% after casting the TNT. Indeed, the porosity after casting must be low to avoid extragranular defects likely to generate hot spots that would make the composition more sensitive. Table 3 sums up the comparative tests which were performed: all the compositions tested associate an overall mass of ONTA/RDX mixture of 48% and a mass of TNT/aluminium/casting additives of 52%. The global mass of aluminium is classically of between 0 and 15% of the whole composition, whereas the additives (phlegmatizers such as wax, associated with an emulsifier and the possible addition of graphite) represent around 7% in mass of the composition produced. A mass of aluminium of at least 5% in mass will be preferred thereby enabling the porosity to be further reduced with an aluminium having a mean particle size of around 43 micrometers (Table 2). This choice also allows the density of the composition to be increased as well as its thermal conductivity, thereby improving its resistance to the slow and fast cook off tests. The compositions thus only differ by the relative percentages of ONTA (type 1) 200-400 micrometers and insensitive RDX 315-800 micrometers.

The last two lines of the table show the performances of an insensitive composition with no RDX and those of a non insensitive composition associating TNT and non insensitive RDX (50%).

TABLE 3

| Explosive compositions | Porosity | Detonation rate (metres/second) | Fast cook off simulation (time before reaction) | Slow cook off simulation (time before reaction) |
|---|---|---|---|---|
| TNT + aluminium and additives 52% ONTA 33%/insensitive RDX 15% | 0.3% | 7075 | 89 seconds | 51.3 hours |

TABLE 3-continued

| Explosive compositions | Porosity | Detonation rate (metres/second) | Fast cook off simulation (time before reaction) | Slow cook off simulation (time before reaction) |
|---|---|---|---|---|
| TNT + aluminium and additives 52% ONTA 29%/ insensitive RDX 19% | 0.3% | 7090 | 90.7 seconds | 50.8 hours |
| TNT + aluminium and additives 52% ONTA 24%/ insensitive RDX 24% | 0.4% | 7177 | 89.2 seconds | 50.2 hours |
| TNT + aluminium and additives 52% ONTA 21%/ insensitive RDX 27% | 0.3% | 7250 | 90.5 seconds | 51 hours |
| Reference 1 composition TNT + aluminium and additives 52% ONTA 48% (insensitive composition with no RDX) | 1.4% | 6960 | 85 seconds | 50.4 hours |
| Reference 2 composition non insensitive TNT 50% non insensitive RDX 50% | 2% | 7640 | not performed | 42 hours |

The slow and fast cook off tests were performed in accordance with the corresponding AFNOR standards. The simulations were performed in the same experimental conditions as for the actual trials (temperature ramps defined by standard NFT 70-503 and heat flux ramps defined by standard NFT 70-513).

Table 3 reveals that the low porosity compositions obtained (lines 1 to 4) provide the same insensitivity level of a reference insensitive composition such as Reference composition 1 (line 5 of Table 3). However, they present a detonic rate analogous to that of an explosive that is not insensitive, such as Reference composition 2 given in line 6 of Table 3.

Explosive compositions may thus be made in which the solid part associates:

15% to 30% in mass of oxynitrotriazole,

24% to 50% in mass of insensitive cyclonite and 0 to 15% in mass of aluminium.

The percentages in mass are relative to the total mass of the solid part.

It is naturally possible to implement the invention with types of meltable explosives other than trinitrotoluene (TNT).

Thus, an aromatic nitro compound listed in patent EP814069 can be used: 2,4,6-Trinitro-N-Methyl Aniline, 2,4,6-Trinitro-3-methylphenol, 3-Amino-Trinitrotoluene, 2,4,6-Trinitro-Aniline, 1,3,8-Trinitronaphtalene and its mixture of isomers meltable at 115° C., 2,4-dinitroanisole (DNAN).

All these explosives have chemical stability analogous to that of TNT, thereby ensuring behaviour to sympathetic detonation trials and bullet impact trials that is close to that of TNT.

Naturally, in the composition according to the invention, the meltable part associates a meltable explosive and a suitable phlegmatizer (such as wax) whose melting temperature will be selected substantially equal to that of the explosive (plus or minus 2° C.), the proportion of phlegmatizer shall be selected greater than 3% and preferably in the magnitude of 25% of the mass of the meltable part. The mass of the phlegmatizer will thus be of 7% to 10% in mass for a mass of the meltable part of between 30% and 40% of the total mass of the composition. It is furthermore well known to one skilled in the art for the phlegmatizer to be associated with one or several casting additives such as graphite and an emulsifier.

By way of example, different compositions (previously listed in Table 3) were produced for which the criterion of sensitivity (CS) was calculated (expressed in square kilocalories per mole).

This criterion of sensitivity (CS) has been described in patent EP814069. It is derived from the works conducted in the chemical industry (thermodynamic Code criterion C4 of the CHETAH ASTM Chemical Thermodynamic Energy Release Evaluation Program published in November 1974—Authors: M M Scaton, Freedman and Treweek). It was evaluated in the scope of the thesis presented to the University of Orleas in 1997 by Maryse Vaullerin: "Study of the vulnerability of energetic molecules and formulations".

This criterion is based on the calculation of the thermochemical properties of the different constituents of a composition and namely the enthalpy and the number of gram atoms. It enables the potential risk of thermal explosion to be expressed with a relatively high degree of reliability. These works have demonstrated that for an explosive to be considered as insensitive to the main tests presented in the standards (AFNOR NFT 70510 or trials UN 7d)i to 7k)), the CS calculated must be less than 100. Note that when this criterion CS is less than 100, the composition is always insensitive. When the criterion CS exceeds 120 the composition is always sensitive. However, there is a zone of transition when the CS is between 100 and 120, zone in which the compositions may be insensitive, which is verified by the trials. All the compositions proposed in the following examples have a CS of less than 120 and are insensitive.

EXAMPLE 1

Table 3 Line 4

21% in mass of oxynitrotriazole,

27% in mass of insensitive cyclonite,

14% in mass of aluminium,

31% in mass of trinitrotoluene,

7% in mass of a mixture of was and casting additives.

This composition has a detonation rate of 7250 m/s and a criterion of sensitivity CS of 115 $Kcal^2$/mol. Its porosity is of 0.3%.

EXAMPLE 2

Table 3 Line 2

29% in mass of oxynitrotriazole,

19% in mass of insensitive cyclonite,

14% in mass of aluminium,

31% in mass of trinitrotoluene,

7% in mass of a mixture of was and casting additives.

This composition has a detonation rate of 7090 m/s and a criterion of sensitivity CS of 108 $Kcal^2$/mol. Its porosity is of 0.3%.

EXAMPLE 3

Table 3 Line 3

24% in mass of oxynitrotriazole,

24% in mass of insensitive cyclonite,

14% in mass of aluminium,

31% in mass of trinitrotoluene,

7% in mass of a mixture of was and casting additives.

This composition has a detonation rate of 7177 m/s and a criterion of sensitivity CS of 112 $Kcal^2$/mol. Its porosity is of 0.4%.

EXAMPLE 4

Table 3 Line 1

33% in mass of oxynitrotriazole,
15% in mass of insensitive cyclonite,
14% in mass of aluminium,
31% in mass of trinitrotoluene,
7% in mass of a mixture of was and casting additives.

This composition has a detonation rate of 7075 m/s and a criterion of sensitivity CS of 106 $Kcal^2$/mol. Its porosity is of 0.4%.

The explosive composition according to the invention can be implemented in the load of any type of projectile or warhead. This composition may thus be used to load artillery shells or the bodies of bombs or missiles.

With respect to the manufacturing process for this composition:

on the one hand, the meltable explosive to which the phlegmatizer and additives have been added will be melted,
on the other, the different constituents of the solid part (ONTA, Aluminium, insensitive cyclonite) will be mixed together.

The solid part will then be incorporated into the melted part, making the mixture homogeneous (using a container equipped with a mixer). The melting and mixing will be performed in a vacuum. Casting in the ammunition body will also be performed in a vacuum. Casting equipment suitable for such vacuum casting is described by patent FR2923005.

The invention claimed is:

1. An insensitive melt-cast explosive composition incorporating a meltable part formed of at least one meltable explosive and, a solid part incorporating oxynitrotriazole (ONTA) and insensitive cyclonite (insensitive RDX), wherein the particle size of the insensitive cyclonite being of between 315 micrometers and 800 micrometers, and the particle size of the ONTA is of between 200 micrometers and 400 micrometers, the ONTA further having an apparent density greater than or equal to 0.95 g/$cm^3$.

2. An explosive composition according to claim 1, wherein the meltable explosive is selected from among the following compounds: Trinitrotoluene, 2,4,6-Trinitro-N-Methyl Aniline, 2, 4, 6-Trinitro-3-methylphenol, 3-Amino-Trinitrotoluene, 2, 4, 6-Trinitro-Aniline, 1, 3, 8-Trinitronaphtalene and its mixture of isomers meltable at 115° C., 2,4-dinitroanisole (DNAN).

3. An explosive composition according to claim 1, wherein the meltable part constitutes between 30% and 40% of the total mass of the composition.

4. An explosive composition according to claim 1, wherein the solid part includes:

15% to 25% in mass of oxynitrotriazole,
24% to 50% in mass of insensitive cyclonite and
0 to 25% in mass of aluminium,
the percentages in mass being relative to the total mass of the solid part.

5. An explosive composition according to claim 4, wherein the explosive composition includes:

15% to 30% in mass of oxynitrotriazole,
15% to 30% in mass of insensitive cyclonite,
0 to 15% in mass of aluminium,
20% to 33% in mass of trinitrotoluene, and
7% to 10% in mass of a mixture of wax and casting additives,
the percentages in mass being relative to the total mass of the composition.

6. An explosive composition according to claim 5, wherein the explosive composition includes:

21% in mass of oxynitrotriazole,
27% in mass of insensitive cyclonite,
14% in mass of aluminium,
31% in mass of trinitrotoluene, and
7% in mass of a mixture of wax and casting additives.

7. An explosive composition according to claim 5, wherein the explosive composition includes:

24% in mass of oxynitrotriazole,
24% in mass of insensitive cyclonite,
14% in mass of aluminium,
31% in mass of trinitrotoluene, and
7% in mass of a mixture of wax and casting additives.

8. An explosive composition according to claim 5, wherein the explosive composition includes:

29% in mass of oxynitrotriazole,
19% in mass of insensitive cyclonite,
14% in mass of aluminium,
31% in mass of trinitrotoluene, and
7% in mass of a mixture of wax and casting additives.

9. An explosive composition according to claim 5, wherein the explosive composition includes:

33% in mass of oxynitrotriazole,
15% in mass of insensitive cyclonite,
14% in mass of aluminium,
31% in mass of trinitrotoluene, and
7% in mass of a mixture of wax and casting additives.

10. An explosive composition according to claim 2, wherein the meltable part constitutes between 30% and 40% of the total mass of the composition.

11. An explosive composition according to claim 2, wherein the solid part includes:

15% to 25% in mass of oxynitrotriazole,
24% to 50% in mass of insensitive cyclonite and
0 to 25% in mass of aluminium, the percentages in mass being relative to the total mass of the solid part.

12. An explosive composition according to claim 3, wherein the solid part includes:

15% to 25% in mass of oxynitrotriazole,
24% to 50% in mass of insensitive cyclonite and
0 to 25% in mass of aluminium,
the percentages in mass being relative to the total mass of the solid part.

13. An explosive composition according to claim 10, wherein the solid part includes:

15% to 25% in mass of oxynitrotriazole,
24% to 50% in mass of insensitive cyclonite and
0 to 25% in mass of aluminium, the percentages in mass being relative to the total mass of the solid part.

14. An explosive composition according to claim 1, wherein the meltable explosive is Trinitrotoluene.

* * * * *